United States Patent [19]

Frost et al.

[11] Patent Number: 4,743,804

[45] Date of Patent: May 10, 1988

[54] E-BEAM IONIZED CHANNEL GUIDING OF AN INTENSE RELATIVISTIC ELECTRON BEAM

[75] Inventors: Charles A. Frost; Brendon B. Godfrey; Paul D. Kiekel; Steven L. Shope, all of Albuquerque, N. Mex.

[73] Assignee: The United States of America as represented by the United States Department of Energy, Washington, D.C.

[21] Appl. No.: 855,529

[22] Filed: Apr. 25, 1986

[51] Int. Cl.[4] ..... H05H 1/03

[52] U.S. Cl. ..... 315/5.14; 315/4; 315/5; 315/5.34; 315/39; 328/227; 328/228; 376/107; 376/127; 313/161; 313/325

[58] Field of Search ..... 315/3, 5, 4, 5.14, 111.61, 315/111.81, 111.21, 39, 5.34; 328/228, 233; 376/107, 127; 313/161, 325

[56] References Cited

U.S. PATENT DOCUMENTS 3,831,101 8/1974 Benford et al. ..... 328/230
4,548,782 10/1985 Manheimer et al. ..... 376/127

OTHER PUBLICATIONS

"Electron Beam Guiding and Phase-Mix Damping by a Laser-Ionized Channel", Physical Review Letters, (54)7, 2-18-85, pp. 685-688.

Van Nostrand's Scientific Encyclopedia, Fifth Ed., p. 1476.

"Electron Beam Guiding and Phase-Mixed Damping by an Electrostatically Charged Wire", Phys. Rev. Let. 51(9) 8/1983, pp. 723-726.

"Magnetic Bending of Laser Guided Electron Beams" [Sand85-0041C] 1985, Particle Accel. Conference, 5/1985.

"IFR Guiding Experiments" [Sand85-1450C] 1985 Annual Propagation Review, 6/1985.

*Primary Examiner*—David K. Moore
*Assistant Examiner*—Mark R. Powell
*Attorney, Agent, or Firm*—George H. Libman; James H. Chafin; Judson R. Hightower

[57] ABSTRACT

An IREB is guided through a curved path by ionizing a channel in a gas with electrons from a filament, and confining the electrons to the center of the path with a magnetic field extending along the path. The magnetic field is preferably generated by a solenoid extending along the path.

11 Claims, 1 Drawing Sheet

E-BEAM IONIZED CHANNEL GUIDING OF AN INTENSE RELATIVISTIC ELECTRON BEAM

The United States Government has rights in this invention pursuant to Contract DE-AC04-76DP00789 between the U.S. Department of Energy and AT&T Technologies, Inc.

BACKGROUND OF THE INVENTION

This invention relates generally to guiding an Intense Relativistic Electron Beam (IREB), and more particularly to using low energy electrons formed by a magnetic field into a channel through an ionizable gas to guide an IREB along a curved path.

IREBs are short (10's of nanoseconds) pulses of very high voltage (MeV) electrons and high current (10k's of Amperes). They are useful for radiography, laser pumping, microwave generation, beam propagation and basic physics research, etc. IREBs are typically formed by a cathode generating high power electrons towards an anode. Generators may either have a large magnet for focusing the electrons away from the anode and into a beam, or a thin metal foil for diverting the electrons from the anode, permitting them to pass down the channel. Additional information on these generators is provided by R. B. Miller, *An Introduction to the Physics of Intense Charge Particle Beams,* Plenum Press, New York, 1982. An IREB may also be generated using an ionized channel as taught by the copending patent application of C. Frost, G. Leifest and S. Shope entitled, "Ionized Channel Generation of an Intense Relativistic Electron Beam", Ser. No. 846,530, filed on Mar. 31, 1986, and assigned to the assignee of this application.

It is known that when an IREB beam is injected into a preionized channel, the beam space charge ejects plasma electrons, leaving an ion core which electrostatically attracts electrons to the ion channel.

D. S. Prono et al., "Electron-Beam Guiding and Phase-Mix Damping by Electrostatically Charged Wire," Phys. Rev. Lett. 51, 9, Aug. 29, 1983, pp. 723–726, discusses two experiments where a positive line charge was formed along a charged graphite wire supported on graphite foils. Prono found the charged wire to focus and damp the beam along the wire.

U.S. Pat. No. 4,507,614 issued to Prono et al. in 1985. This patent describes experiments with and without the charged wire. Beam transport was very poor without the wire.

W. E. Martin et al., "Electron-Beam Guiding and Phase-Mix Damping by a Laser-Ionized Channel," Phys. Rev. Lett. 54, 7, Feb. 18, 1985, pp. 685–688, reported the use of a laser-ionized channel for relativistic electron beam guiding, focusing and damping. They found the channel radius should be smaller than the beam radius for the radial focusing force to be anharmonic and thereby lead to desirable phase-mix damping of the transverse beam motion. They also found the electron beam density should be greater than the channel-ionization density to prevent beam instability.

SUMMARY OF THE INVENTION

It is an object of this invention to provide a new technique for guiding an IREB.

It is another object of this invention to electrostatically guide an IREB along a channel.

It is also an object of this invention to use electrons along a magnetic field line to ionize a gas, forming a channel for guiding an IREB.

Additional objects, advantages and novel features of the invention will become apparent to those skilled in the art upon examination of the following description or may be learned upon practice of the invention. The objects and advantages of the invention may be realized and attained by means of the instrusentalities and combinations particularly pointed out in the appended claims.

To achieve the foregoing and other objects in accordance with the purpose of the present invention, as embodied and broadly described herein, the method of the invention comprises generating electrons along a magnetic field line passing through an ionizable gas, and generating an IREB along the ionized channel formed by the electrons. The structure for practice of this method includes an ionizable gas and electron impact ionization means for forming a strongly ionized channel through the gas. The ionization means consists of means for generating low energy electrons, such as a filament, and a magnet, such as a solenoid, for generating a magnetic field to guide the low energy electrons through the gas.

DETAILED DESCRIPTION OF THE INVENTION

Figure 1:
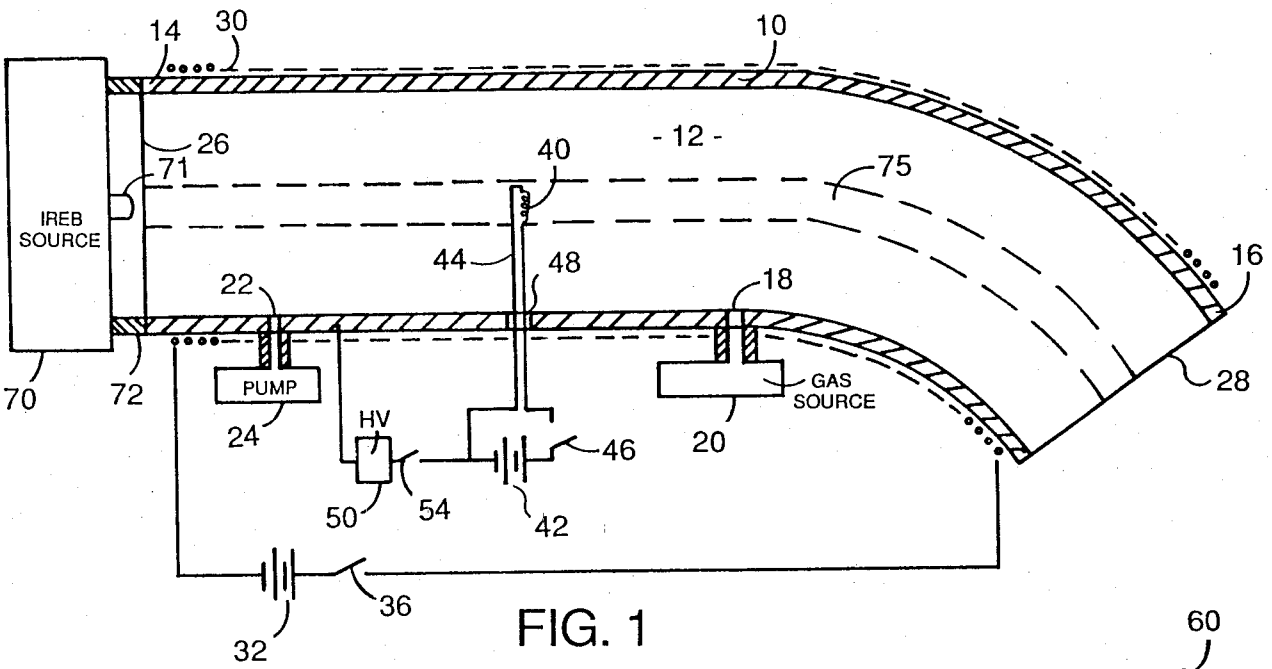
FIG. 1 is a schematic representation of an embodiment of the invention.

In accordance with a preferred embodiment of the invention, a hollow, cylindrical, tube 10 having a circular cross-section extends from an input end 14 to an output end 16. The inside volume 12 of tube 10 contains an ionizable gas at low pressure, as described hereinafter. Tube 10 may be constructed of any material that will not be crushed by the difference in pressure between the outside and inside of the tube.

If tube 10 is placed within a low pressure atmosphere of ionizable gas, such as a vacuum chamber (not shown), the ends of the tube may be open. However, if tube 10 is surrounded by normal atmosphere, 10 mil titanium foils 26 and 28 may be used to seal tube ends 14 and 16, respectively. In addition, an input port 18 connected through a valve as well known in the art to a source of ionizable gas 20, and an output port 22 connected to a vacuum pump 24, will maintain interior 12 of tube 10 at the desired low pressure.

In operation, an IREB is injected into input end 14 of tube 10 by any conventional IREB source. The beam is guided to output end 16 along a channel of ionized gas without significant losses or spreading of the diameter of the beam. In accordance with this invention, tube 10 does not have to follow a linear path.

In order to successfully guide a beam in the ion focused regime (IFR) mode, sufficient channel ionziation must be provided to overcome beam space charge expansion; or $f_e$ must be greater than $^{-2}$, where $f_e$ is the ratio of channel to beam linear charge density (the product of ion or beam number density times ion or beam cross-sectional area) and is the Lorentz factor. In addition, $f_e$ must be less than one, or excess plasma electrons will remain in the channel to form a destabilizing return current leading to violent instability and rapid ejection of the beam from the channel. However, since beaminduced ionization will cause $f_e$ to grow during the beam pulse to exceed one, very low gas pressure in chamber 30 is usually required.

As noted above, the prior art has used both electrostatically charged wires and lasers to provide ionized channels for guiding IREBs.

The charged wire was a fragile graphite wire supported only at its ends to keep it straight. Any sharp bends in this wire would cause a sudden change in beam direction and probably would lead to beam instability.

Prior to this invention, applicants used a large, expensive ($75K) ultraviolet laser to ionize diethylaniline (DEA) gas at 0.1 mTorr. DEA is a large organic molecule capable of being photo-ionized by the laser and the IREB. Disadvantages of DEA are that when the pressure is set for $f_e<1$, the IREB can cause additional ionization, raising $f_e>>1$ and causing 2-stream instability. In addition, DEA is a toxic gas requiring careful handling.

In this invention, applicants have shown higher ionization allows operation at lower gas pressure when an inexpensive filament is used to inject electrons into tube 10, and a solenoid is used form a magnetic field to guide the electrons along a channel where they collide with gas molecules, forming an ionized channel for transport of an IREB.

In particular, FIG. 1 shows a preferred channel ionization means for this invention to include a filament 40 held at the center of the cross-section of tube 10 by one end of a pair of insulated wires 44 extending through a wire port 48 in tube 10. As shown, the other end of wires 44 may have a switch 46 and a low voltage power source such as a battery 42 serially connected therebetween.

Another source 50 is connected between the grounded wall of tube 10 and the other end of wires 44 in order to bias filament 40 negatively with respect to tube 10. Ionization level is controlled by variation of the bias current. Although source 50 is shown as a DC source, it is contemplated that this bias current could also be pulsed.

The electrical circuit of the invention may also include a solenoid 30 extending from input end 14 to output end 16 and consisting of many turns of insulated wire conveniently wound around the outer surface of tube 10. A DC source 32 is connected between the ends of solenoid 30. AC and pulse sources have also been used to power solenoid 32, as this embodiment will operated with any known construction capable of generating a magnetic field of approximately 100 to 200 Gauss within tube 10.

The operation of this embodiment of the invention is as follows:

Interior 12 of tube 10 is pumped down to approximately $10^{-6}$ Torr (to remove impurities) and then backfilled to 0.01 to 1.0 mTorr of an ionizable gas such as argon. If ends 14 and 16 are sealed by foils 26 and 28, gas may be bled into interior 12 through port 18 while it is pumped out through port 22.

The electrical circuit is energized after the proper atmosphere is achieved: switch 36 is closed to energize solenoid 30, switch 54 is closed to bias filament 40 negatively with respect to tube 10, and switch 46 is closed to enable current from source 42 to heat filament 40, thereby boiling electrons from the surface of filament 40 into interior 12. (The filament is not destroyed by the current from source 42 because of the vacuum in the tube.) Because the wall of tube 10 is positively biased with respect to filament 40 by source 50, electrons are attracted away from filament 40 towards tube 12 in all directions. However, the electrons are also attracted to, and go into spiral orbits along, magnetic field lines. In accordance with the well known Larmor radius, the maximum distance each electron moves from a magnetic field line is directly proportional to the electron velocity perpendicular to the surface of tube 12 and indirectly proportional to the magnetic field. The magnetic field also prevents undesirable perpendicular diffusion of channel electrons.

The arrangement of magnetic field lines ensures that electrons spiral along only the magnetic field lines passing through filament 40. The solenoid ensures that the magnetic field lines passing through filament 40 are centered within tube 10 from end 14 to end 16. Accordingly, the invention provides an electron flow spiraling along the center of tube 10. The spiral path taken by each electron increases the probability that each electron will collide with an argon molecule, forming a channel of argon ions centered in tube 10 and extending from input end 14 to output end 16.

Once the channel is formed, the IREB may be fired into input end 14 of tube 10. The space charge of the relativistic beam electrons blows out the electrons in the ionized channel leaving a core of ions 75 to confine and guide the electron beam to output end 16. As shown by Martin et al. and Prono et al., if the radius of the ionized channel $r_c$ is not greater than the radius of the IREB $r_b$, the radial focusing force will be anharmonic leading to phase-mix damping of transverse beam motion. In other words, the beam will follow the ionized channel and unwanted perturbations in the beam will be damped out.

Since tube 10 has a constant cross-section along its length, and since solenoid 30 is wound around tube 10 along its length, the magnetic field of solenoid 30 is coaxial with tube 10 along any configuration of tube 10. In other words, this invention provides an ionized channel following a curved path.

Figure 2:
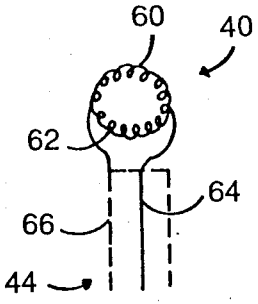
FIG. 2 is a detail of filament construction for one embodiment of the invention.

FIG. 2 shows a specific embodiment of filament 40 of FIG. 1. In particular, filament 40 consists of two tungsten filaments 60 and 62, each about 20 mm long, removed from automobile tail-light bulbs, connected in parallel and stretched in the approximate shape of a circle. The connected ends of the filaments are connected to center conductor 64 and outer conductor 66 of coaxial cable 44. The rigidity of cable 44 is sufficient to hold filament 40 centered in tube 10 perpendicular to the magnetic field.

Any source of IREB may be used with this invention. The prior art generator 70 shown in FIG. 1 has a thin metal foil extending across its output, axially aligned with a cathode 71 and connected to an anode 72. When used with this invention, input foil 26 is the IREB foil. Electrons from the cathode are attracted to the closer foil and, because of the thinness of the foil and the extremely high potential of the electrons, pass through the foil into tube 10.

An alternative prior art generator has a large magnet (e.g. 20 kG) situated around the output of an anode to guide the electrons towards the ionized path. Such a generator does not use foil 26, the input end 14 of tube 10 being vacuum sealed to the structure of the IREB generator.

Another source of IREB is a conventional tubular transport system whereby the output of a remote IREB source is amplified and transported to foil 26. In such an embodiment, the invention could be use to transport the IREB through a turn.

A preferred source of IREB is the foilless diode of Ser. No. 846,530, referenced above. With this source, an anode having an aperture for the passage of the IREB is used in place of foil 26, the IREB generator is vacuum sealed to tube 10, and output port 22 and pump 24 would extend through the IREB generator as taught in that patent application.

This invention will work with any ionizable gas, including air. Neon, argon, xenon, and krypton may advantageously be used in the practice of this invention because these gases have a relatively large electron impact ionization cross-section.

Although disclosed with an inexpensive filament as the low energy electron source, other sources may also be used in the practice of the invention. Applicants have used a low energy, 800 eV electron beam, generated in an electron gun consisting of a hot tungsten filament and a copper anode plate in a magnetic field at the output end of tube 10 to ionize a channel in a 3 meter long, 5 centimeter radius, drift tube containing 0.1 to 0.3 mTorr argon. The channel transported a 1.2 MeV IREB of approximately 20 kA both straight and through a 90° bend with no appreciable loss.

Very low background gas pressures are desirable to minimize the occurrence of impurities such as hydrocarbons or other residual gases. The impurities may contain low mass atoms of hydrogen or helium, which atoms generate light ions in collisions with the electrons. These light ions can cause IREB instability.

Using the filament of FIG. 2 heated by 18 volt source 42 and biased by 300 volt high voltage source 50, a IREB of several Mev has been transported through a 16 meter tube.

The formation of an ionized channel using a low energy electron beam has a distinct advantage over the prior art laser ionization. The cross section for impact ionization of a gas such as argon is much greater than the cross section of organic gases such as DEA used in two-step laser photoionization. A correspondingly higher pressure of DEA is therefore necessary to achieve a given $f_e$. When an IREB is propagated by a laser ionized channel, additional ionization of DEA can occur, causing an increase in $f_e$ and leading to a 2-stream instability if $f_e >> 1$. Inorganic gases such as argon are not as easily ionized by the IREB, and can be used at lower pressure, resulting in more stable beam propagation.

One further advantage is that this invention has less critical timing requirements than the laser ionization system. When a laser ionizes a channel, the IREB must be quickly fired (within 100 nanoseconds) before the plasma electrons formed in the channel can escape to the positively charged tube wall. With this invention the magnetic field of solenoid 30 traps plasma electrons with the electrons generated by filament 40. Therefore, the IREB may be fired any time after the channel is ionized.

The particular sizes and devices discussed above are cited merely to illustrate a particular embodiment of the invention. It is contemplated that the use of the invention may involve different materials, configurations and sizes as long as the principle, using an ionized channel to capture an electron beam near a cathode to provide an IREB, is followed. For example, although the tube conveniently serves as a support structure for the solenoid, it can be eliminated if other means are provided for generating the magnetic field, such as Helmholtz coils. It is intended that the scope of the invention be defined by the claims appended hereto.

We claim:

1. Apparatus for guiding a pulse of high energy electrons having a radius $r_b$, said apparatus including:

means for containing an ionizable gas;

electron impact ionization means for generating an ionized channel through said gas, said channel having radius $r_c < r_b$ and satisfying the relationship: $1 > f_e > \gamma^{-2}$ wherein $f_e = n_c r_c^2 / n_b r_b^2$ and $n_c$ is the ion density, $n_b$ is the beam density, and $\gamma =$ the Lorentz factor;

said ionization seans consisting of:

low-energy means for generating low-energy electrons within said means for containing; and magnetic means for generating a magnetic field to guide and confine said low energy electron beam.

2. The apparatus of claim 1 wherein said means for containing comprises a hollow tube.

3. The apparatus of claim 1 wherein said magnetic field follows a curved path.

4. The apparatus of claim 2 wherein said magnetic means comprises a solenoid extending along said tube.

5. The apparatus of claim 4 wherein said low-energy means comprises filament means for releasing electrons, said filament means being centered within said tube.

6. The apparatus of claim 5 wherein said ionizable gas is argon at a pressure of less than 0.3 mTorr and $r_c = 1$ cm.

7. The apparatus of claim 4 wherein said tube is a metal tube.

8. The apparatus of claim 7 wherein said solenoid is wound around the outside of said metal tube.

9. A method of transporting an intense relativistic electron beam comprising:

providing a channel through ionizable gas extending from a first location to a second location by defining a magnetic field line extending from said first location to said second location, and providing electrons along said magnetic field line, said electrons ionizing said gas; and generating an intense relativistic electron beam along said channel.

10. The method of claim 9 wherein a solenoid extends from said first location to said second location and said step of defining a magnetic field comprises generating said magnetic field line with said solenoid.

11. The method of claim 10 wherein a filament is intersected by said magnetic field line, and said electrons are provided by heating said filament.

* * * * *